US007722370B2

(12) United States Patent
Chin

(10) Patent No.: US 7,722,370 B2
(45) Date of Patent: May 25, 2010

(54) SOCKET WITH DETECTION FUNCTIONS

(75) Inventor: Chung-Ta Chin, Taipei (TW)

(73) Assignee: ASUSTeK Computer Inc., Taipei (TW)

( * ) Notice: Subject to any disclaimer, the term of this patent is extended or adjusted under 35 U.S.C. 154(b) by 26 days.

(21) Appl. No.: 12/343,512

(22) Filed: Dec. 24, 2008

(65) Prior Publication Data

US 2009/0170359 A1 Jul. 2, 2009

(30) Foreign Application Priority Data

Dec. 28, 2007 (TW) ..... 96150879 A

(51) Int. Cl.
*H01R 29/00* (2006.01)

(52) U.S. Cl. ..... 439/188; 439/676

(58) Field of Classification Search ..... 439/676, 439/188

See application file for complete search history.

(56) References Cited

U.S. PATENT DOCUMENTS 6,485,319 B2 * 11/2002 Bricaud et al. ..... 439/188
6,688,899 B2 * 2/2004 Rumpel ..... 439/188
6,780,035 B2 * 8/2004 Bohbot ..... 439/188
7,125,288 B2 10/2006 Schilling
7,578,706 B2 * 8/2009 Wang ..... 439/676
2002/0009930 A1 * 1/2002 Chang ..... 439/677
2004/0067693 A1 4/2004 Arnett
2004/0218757 A1 11/2004 Teng
2004/0219813 A1 * 11/2004 Chang ..... 439/188
2005/0202724 A1 * 9/2005 Dove ..... 439/620

* cited by examiner

*Primary Examiner*—Briggitte R Hammond
(74) *Attorney, Agent, or Firm*—Winston Hsu

(57) ABSTRACT

A socket with a detection function includes a housing; a plurality of metal spring pins installed side by side in the housing; a first detection pin formed on a side of the plurality of metal spring pins and coupled to a system ground; and a second detection pin formed on another side of the plurality of metal spring pins and coupled to a pull up resistor for providing a high voltage level for the second detection pin. The second detection pin includes an elastic metal arm extending toward the first detection pin and formed on the top of the first detection pin. A first metal spring pin is deflected to press down the elastic metal arm of the second detection pin for contacting the first detection pin when a phone cable plug is inserted into the socket.

8 Claims, 6 Drawing Sheets

SOCKET WITH DETECTION FUNCTIONS

BACKGROUND OF THE INVENTION

1. Field of the Invention

The present invention relates to a socket with a detection function, and more particularly to a network socket that detects a type of an inserted plug according to voltage variation of a detection pin.

2. Description of the Prior Art

Currently, fool-proof designs of an RJ-45 network socket are still not good enough, so a phone cable plug of a type similar to a network cable plug, e.g. an RJ-11 plug, can be easily inserted into the network socket. However, since a great difference exists between signals carried on phone cables and network cables, when the phone cable plug is wrongly inserted into the network socket, not only may back-end electronic devices of the network socket be damaged, but the phone-line circuit loop may also enter a short-circuit state, causing the phone line to appear to be engaged.

For example, please refer to FIG. 1. FIG. 1 is a schematic diagram of a circuit loop between a telephone set 11 and a branch exchange 12 in a conventional public switched telephone network (PSTN). When the telephone set 11 is not picked up, or on the hook, a hook switch 112 is in an open-circuit state. At this time, a DC operating voltage that the branch exchange 12 supplies to the telephone set 11, i.e. a voltage between Tip 13 and Ring 14, roughly lies between 36 and 60 volts depending on the country. When alerting an incoming call, an AC ring signal of about a hundred volts (40 to 150 Vpp) is superimposed over the DC operating voltage to ring the telephone set 11 by the branch exchange 12. Therefore, when the phone cable plug is wrongly inserted into the network socket, the back-end electronic devices of the network socket, such as a notebook computer, may be damaged due to inability to bear such high voltages as the DC operating voltage and the AC ring signal. In addition, please refer to FIG. 2. FIG. 2 is a schematic diagram of a pulse transformer 20 built in a conventional network socket. The pulse transformer 20 includes input terminals RX0+ to RX3+, RX0− to RX3− and output terminals TX0+ to TX3+, TX0− to TX3−, for receiving and outputting network signals, respectively, and is utilized for enhancing reception reliability of the network socket by filtering electromagnetic interference from the high frequency differential signals. As shown in FIG. 2, when the phone cable plug is wrongly inserted into the network socket, the Tip 23 and the Ring 24 are respectively coupled to the input terminals RX2+ and RX2−, and since the input terminals RX2+ and RX2− are short-circuited inside the pulse transformer 20, the phone-line circuit loop is then operated in a state similar to an off-hook state of the hook switch 112 in FIG. 1, causing the phone line to seem to be engaged.

On the other hand, since the trend of the notebook computer is toward lightweight and small size development, less space is available at the periphery of the notebook computer for installing input/output ports, except for batteries, optical drives, and cooling fans, so if the phone cable sockets and the network cable sockets could be integrated, the space occupied by these sockets will be reduced effectively.

SUMMARY OF THE INVENTION

It is therefore an objective of the present invention to provide a socket with a detection function.

According to the present invention, a socket with a detection function is disclosed. The socket includes a plurality of metal spring pins, a first detection pin and a second detection pin. The first detection pin is formed on a side of the plurality of metal spring pins, and is coupled to a system ground. The second detection pin is formed on another side of the plurality of metal spring pins, and is coupled to a pull high resistor that provides a high voltage level for the second detection pin. The second detection pin further includes an elastic metal arm extending toward the first detection pin and forming on a top of the first detection pin. The first metal spring pin of the plurality of metal spring pins is pressed down to make the elastic metal arm of the second detection pin contact the first detection pin when a phone cable plug is inserted into the socket.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
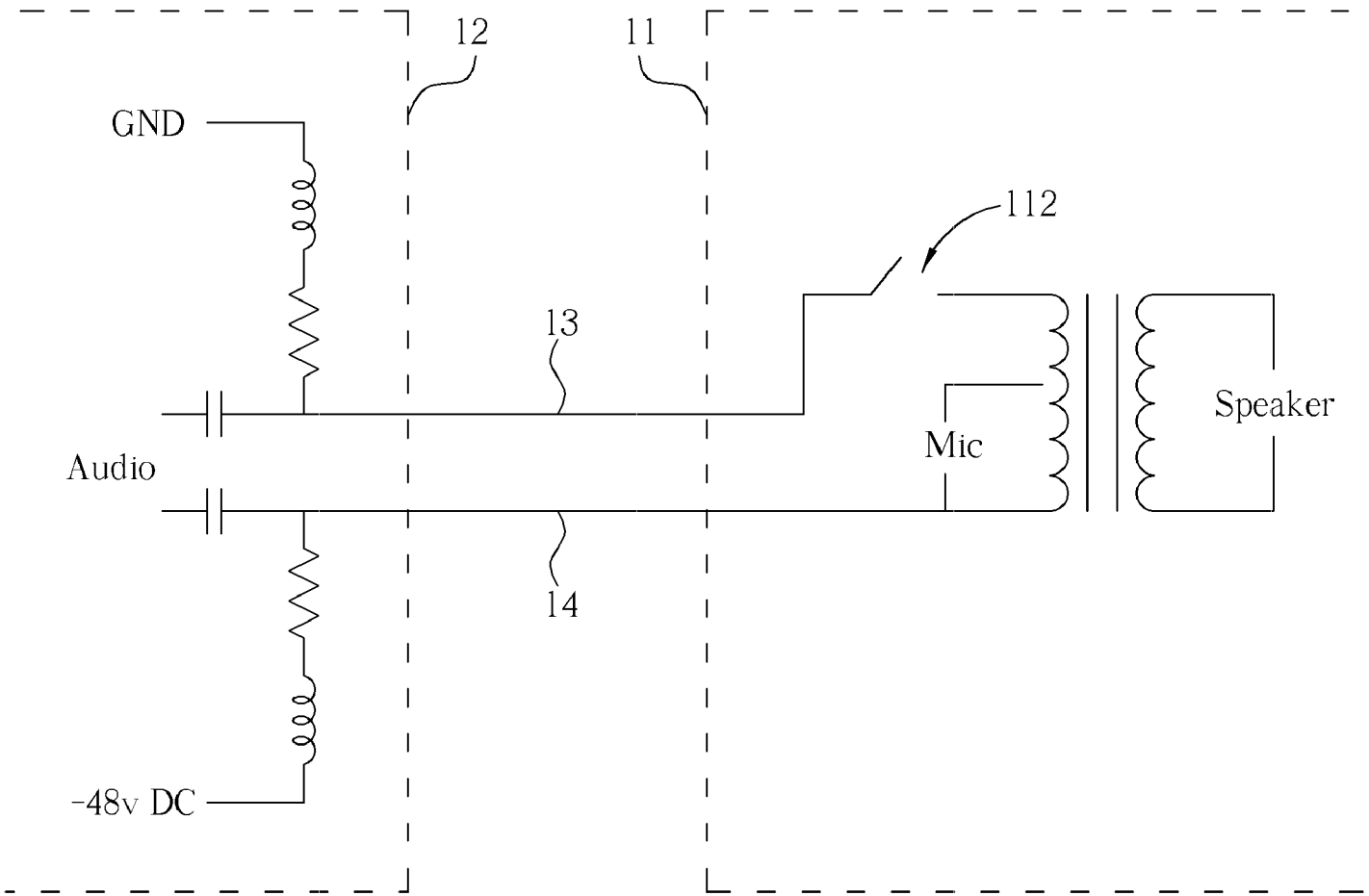
FIG. 1 PRIOR ART
FIG. 1 is a schematic diagram of a circuit loop between a telephone set and a branch exchange in a conventional PSTN.
Figure 2:
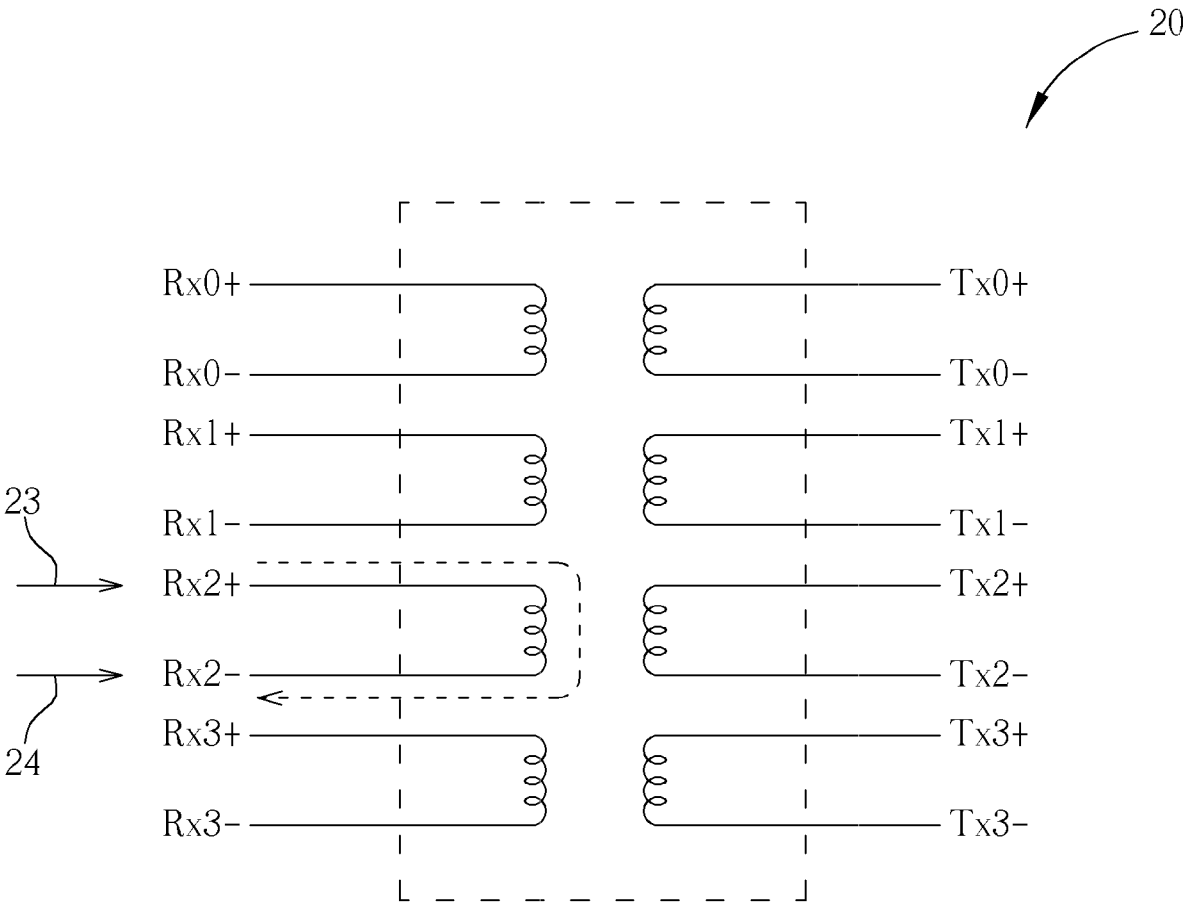
FIG. 2 PRIOR ART
FIG. 2 is a schematic diagram of a pulse transformer built in a conventional network socket.
Figure 3:
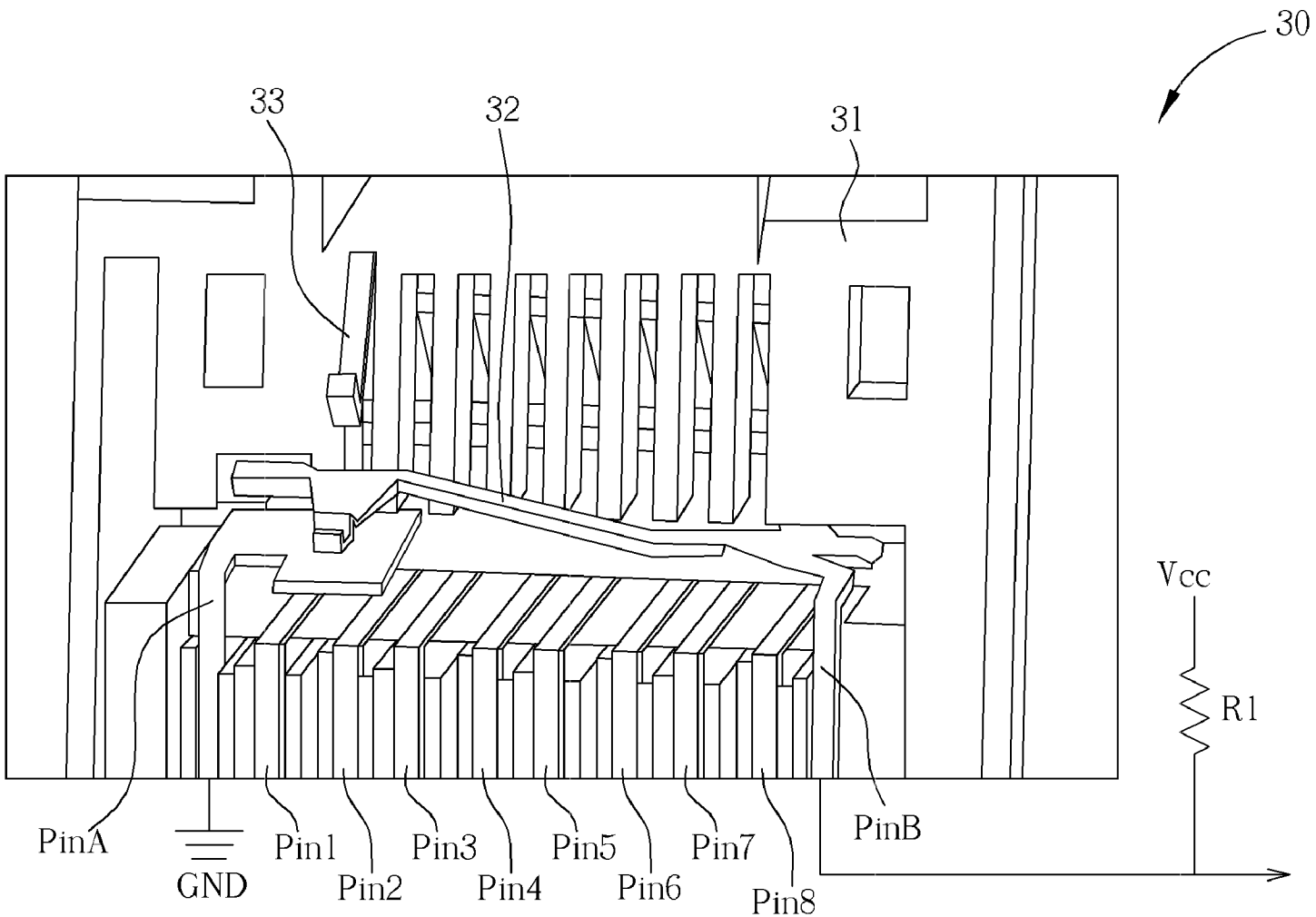
FIG. 3 is a rear-view diagram of a socket with a detection function according to an embodiment of the present invention.

Please refer to FIG. 3. FIG. 3 is a rear-view diagram of a socket 30 with a detection function according to an embodiment of the present invention. The socket 30 includes a housing 31, metal spring pins Pin1 to Pin8, and detection pins PinA and PinB. The metal spring pins Pin1 to Pin8 are placed in parallel inside the housing 31, and are individually utilized for receiving signals. The detection pin PinA is formed on a side of the metal spring pins Pin1 to Pin8, and is coupled to a system ground GND. The detection pin PinB is formed on another side of the metal spring pins Pin1 to Pin8, and is coupled to a pull-up resistor R1 that provides a high voltage level for the detection pin PinB. The detection pin PinB further includes an elastic metal arm 32 extending toward the detection pin PinA and formed on a top of the detection pin PinA. Preferably, the socket 30 is a RJ-45 network socket, and a most lateral metal spring pin of the metal spring pins Pin1 to Pin8, e.g. Pin1, further includes an extension part 33 bended inward and downward to the socket 30.

Figure 4:
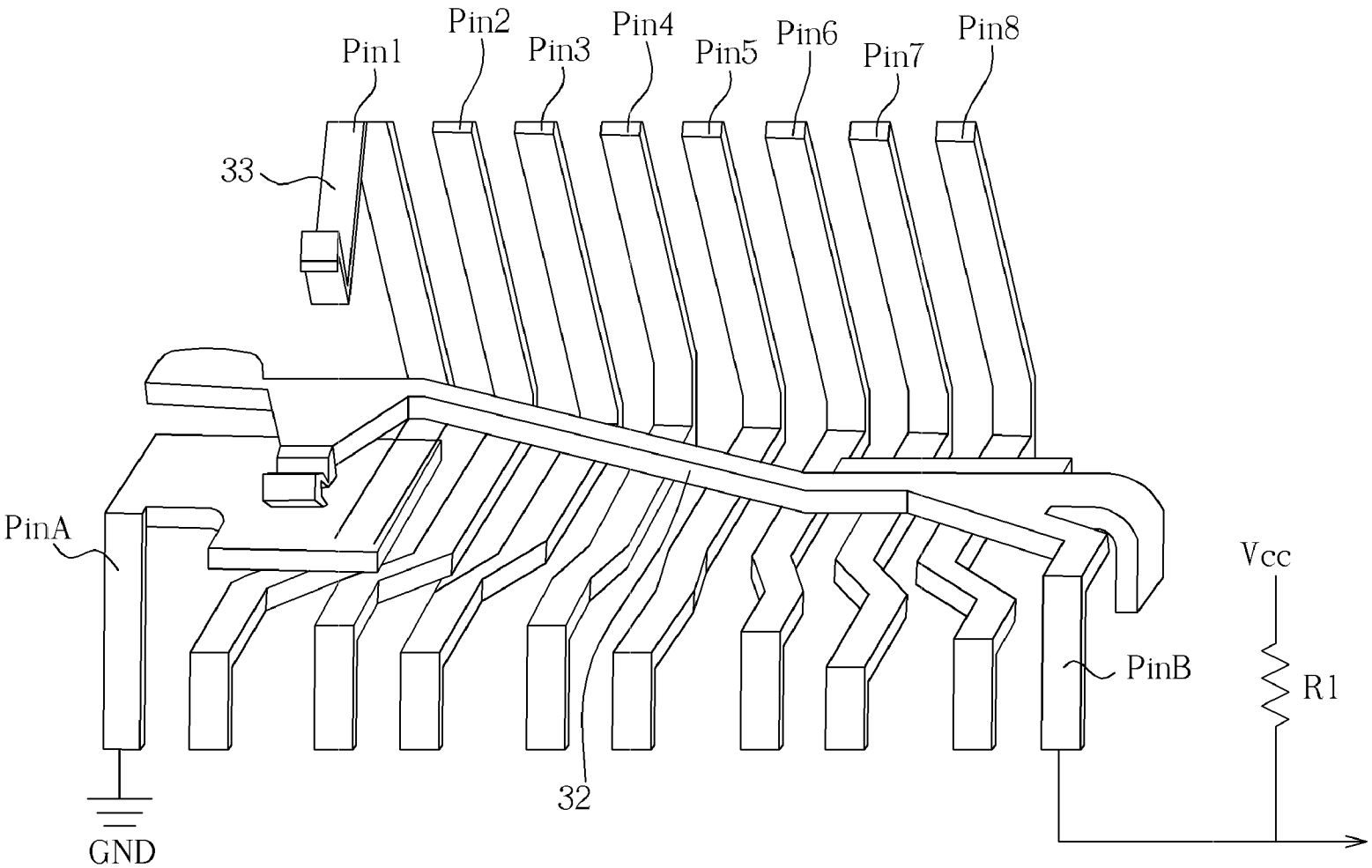
FIG. 4 merely shows the metal spring pins and the detection pins in FIG. 3.

For simple illustration, please further refer to FIG. 4, which merely shows the metal spring pins Pin1 to Pin8 and the detection pins PinA and PinB in FIG. 3. The metal spring pins Pin1 to Pin8 are normal pins of an RJ-45 network socket, and thus when an RJ-45 network cable plug is inserted into the socket 30, network signals can be received by the metal spring pins Pin1 to Pin8, respectively. Such reception operations are well-known by those skilled in the art, and are not narrated herein. Compared with the RJ-45 plug (network cable plug), a RJ-11 plug (phone cable plug) merely has six pins, but spacing between each pin of the phone cable plug is similar to that of the RJ-45 plug. Thus, when an RJ-11 plug (phone cable plug) is inserted into the socket 30, the metal spring pins Pin1 and Pin8 located on each side of the socket 30 are both pressed down by a housing of the phone cable plug. In such a situation, the elastic metal arm 32 of the detection pin PinB is forced to contact the detection pin PinA in the embodiment of the present invention, so that the type of the inserted plug can be determined according to the voltage variation of the detection pin PinB.

Figure 5:
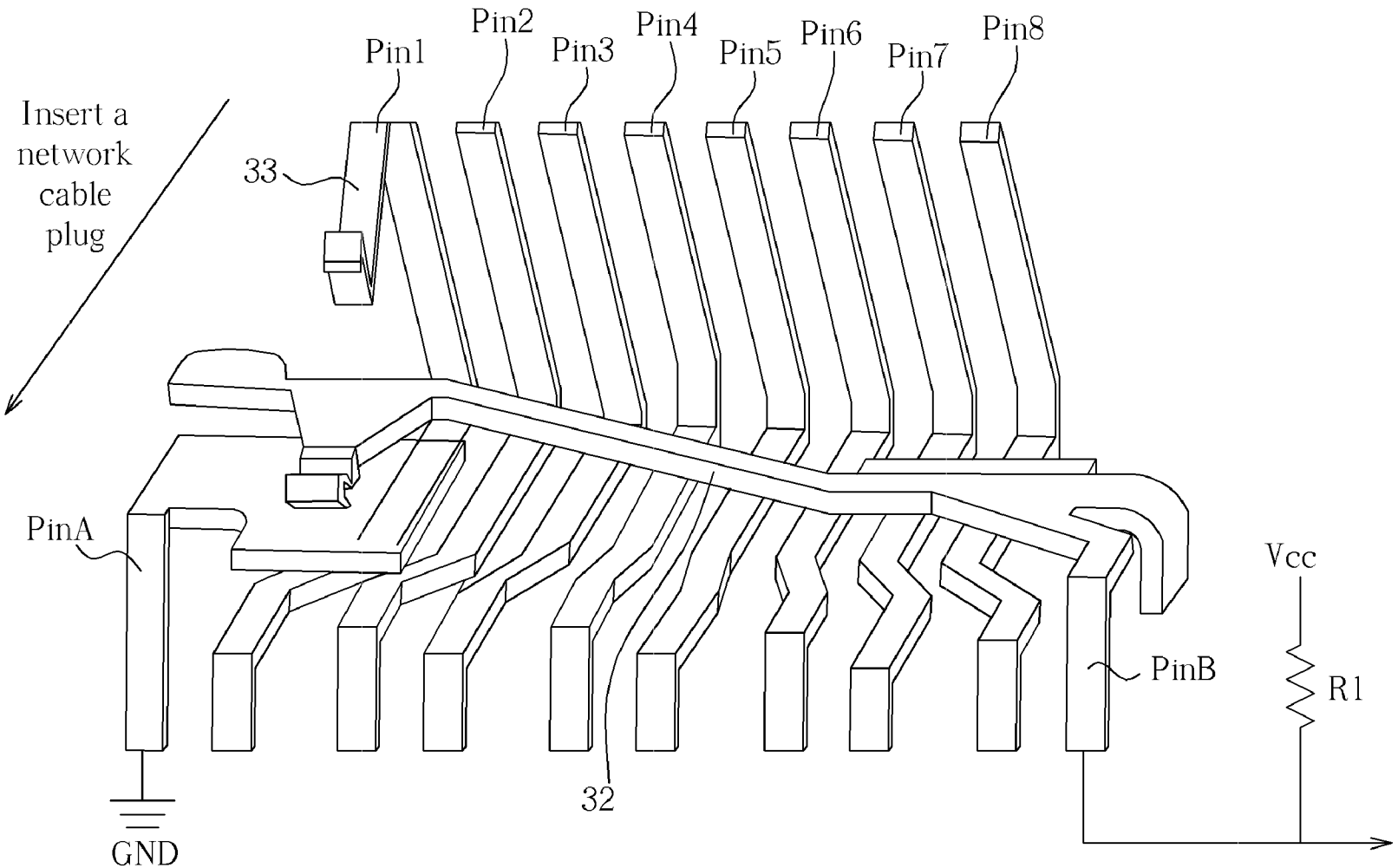
FIG. 5 and FIG. 6 are schematic diagrams of a socket when a network cable plug and a phone cable plug are inserted according to an embodiment of the present invention, respectively.
Figure 6:
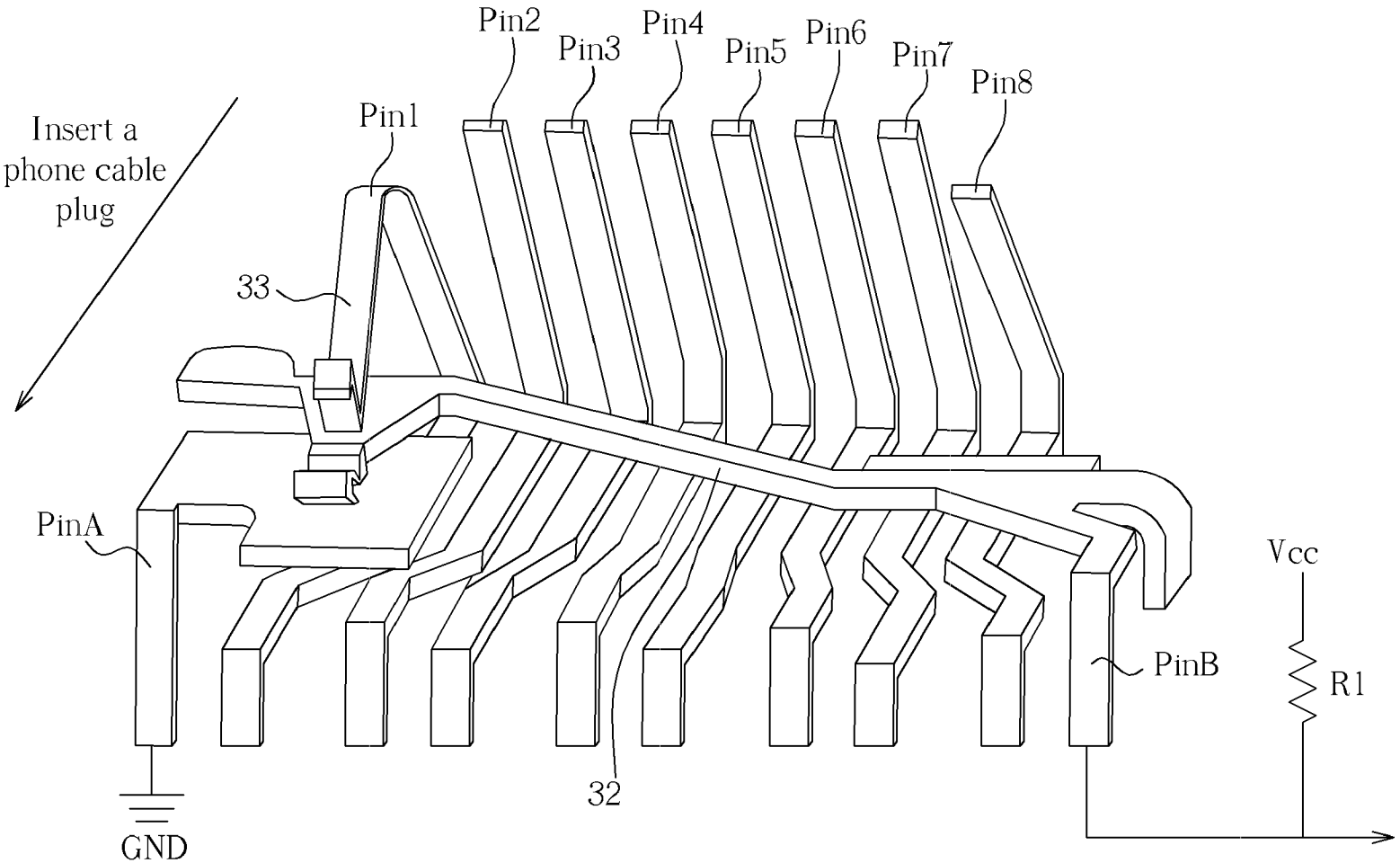

For example, please refer to FIG. 5 and FIG. 6. FIG. 5 and FIG. 6 are schematic diagrams of the socket 30 when a network cable plug and a phone cable plug are inserted according to an embodiment of the present invention, respectively. As shown in FIG. 5, when an RJ-45 plug or no plug is inserted into the socket 30, since the detection pin PinB is not contacted by the detection pin PinA, a voltage level of the detection pin PinB is still kept at a high voltage level provided by the pull-up resistor R1. On the other hand, as shown in FIG. 6, when an RJ-11 plug is inserted into the socket 30, the metal spring pins Pin1 and Pin8 on each side of the socket 30 are both pressed to the bottom by the housing of the phone cable plug, causing the elastic metal arm 32 of the detection pin PinB to contact the detection pin PinA, so as to change the voltage level of the detection pin PinB to that of the detection pin PinA, i.e. the voltage level of the system ground GND.

Therefore, the inserted plug type of the socket can be determined by the voltage variation of the detection pin PinB in the embodiment of the present invention, so as to switch signals received by the metal spring pins Pin1 and Pin8 to couple between a network signal processing module and a phone signal processing module. Moreover, the network sockets (RJ-45 sockets) and the phone sockets (RJ-11 sockets) can then be integrated for reducing the space required by the sockets.

Please note that the above embodiments are merely exemplary illustrations of the present invention, and that those skilled in the art can certainly make appropriate modifications according to practical demands, which also belong to the scope of the invention. For example, the detection pin PinA can further be realized by a metal housing of the socket 30, thereby only one additional detection pin is required to achieve the same detection function in the embodiment of the present invention. Or, the metal spring pin Pin8 can be used for replacing the metal spring pin Pin1 to change the voltage level of the detection pin in another embodiment of the present invention. Such variations also belong to the scope of the present invention.

As mentioned above, the inserted plug type of the network socket can be determined by the voltage variation of the detection pin in the embodiment of the present invention, so as to control the back-end electronic devices to switch reception of the network signals and the phone-line signals. Therefore, the network cable sockets and the phone cable socket can then be integrated for reducing the required space effectively.

Those skilled in the art will readily observe that numerous modifications and alterations of the device and method may be made while retaining the teachings of the invention.

What is claimed is:

1. A socket with a detection function, the socket comprising:

a plurality of metal spring pins;

a first detection pin formed on a side of the plurality of metal spring pins and coupled to a system ground; and a second detection pin formed on another side of the plurality of metal spring pins and coupled to a pull up resistor that provides a high voltage level for the second detection pin, the second detection pin comprising an elastic metal arm extending toward the first detection pin and formed on a top of the first detection pin;

wherein a first metal spring pin of the plurality of metal spring pins is pressed down to make the elastic metal arm of the second detection pin contact the first detection pin when a phone cable plug is inserted into the socket.

2. The socket of claim 1, wherein the first metal spring pin is a most lateral metal spring pin of the plurality of metal spring pins.

3. The socket of claim 1, wherein the first metal spring pin comprises an extension part bended inward and downward to the socket.

4. The socket of claim 1, wherein a voltage level of the second detection pin is equal to that of the first detection pin when the elastic metal arm of the second detection pin contacts the first detection pin.

5. The socket of claim 1, wherein the second detection pin is further coupled to a plug detection circuit, the plug detection circuit being utilized for detecting a type of an inserted plug to switch the plurality of metal spring pins between a network signal processing module and a phone-line signal processing module according to the voltage level of the second detection pin.

6. The socket of claim 1, wherein the first detection pin is a metal housing of the socket.

7. The socket of claim 1, wherein the socket is an RJ-45 socket.

8. The socket of claim 1, wherein the phone cable plug is an RJ-11 plug.

* * * * *